United States Patent [19]

Whiteley

[11] 4,362,090

[45] Dec. 7, 1982

[54] AIR CIRCULATING DEVICE AND METHOD

[76] Inventor: Isaac C. Whiteley, P.O. Box 294, Redmond, Oreg. 97756

[21] Appl. No.: 68,383

[22] Filed: Aug. 21, 1979

[51] Int. Cl.[3] ..... F24F 13/00; F24F 7/00

[52] U.S. Cl. ..... 98/33 A; 98/30; 261/94; 126/113; 219/362

[58] Field of Search ..... 98/33 A, 33 R, 30, 38 R, 98/38 E, 38 F; 165/122; 126/113; 261/99, 94; 219/362, 365; 62/304

[56] References Cited

U.S. PATENT DOCUMENTS

| | | | |
|---|---|---|---|
| 3,789,918 | 2/1974 | Rogalski | 165/19 |
| 3,973,479 | 8/1976 | Whiteley | 98/33 A |
| 4,053,732 | 10/1977 | Carter | 98/33 A |
| 4,064,203 | 12/1977 | Cox | 98/33 A |
| 4,181,690 | 1/1980 | Neu | 98/30 |

FOREIGN PATENT DOCUMENTS

| | | | |
|---|---|---|---|
| 144522 | 3/1931 | Sweden | 98/33 A |

*Primary Examiner*—Albert J. Makay
*Assistant Examiner*—Henry Bennett
*Attorney, Agent, or Firm*—Robert H. Epstein

[57] ABSTRACT

An air circulating device and method includes a base positioned on the floor of a room with a pair of ducts extending therefrom and terminating adjacent the ceiling and fans disposed within the base to draw hot air from the ceiling via one of the ducts and force cold air toward the ceiling via the other duct such that hot air drawn from the ceiling is replaced with cold air drawn from the floor is replaced by hot air drawn from the ceiling. The cold air drawn from the floor is discharged at the ceiling at a rate greater than the rate at which hot air from the ceiling is discharged at the floor, preferably three times as great, to eliminate floor drafts and obtain a proper mixture of cold and hot air. A humidifier is disposed within the base and includes a reservoir of humidifying liquid, a sponge having a portion disposed in the reservoir below a predetermined level and a liquid dispenser for automatically maintaining the humidifying liquid at the predetermined level, air forced through the base by the fans being humidified by picking up moisture from the humidifying liquid as the air passes through perforations in the sponge. An electrical heater can be disposed in the base to heat air after it is humidified, and a germicidal lamp can be disposed along one of the ducts to irradiate air flowing therethrough with ultraviolet light.

22 Claims, 5 Drawing Figures

AIR CIRCULATING DEVICE AND METHOD

BACKGROUND OF THE INVENTION

1. Field of the Invention

The present invention pertains to the circulation of air in a room and, more particularly, to a device and method for circulating air between the floor and ceiling of a room to reduce a temperature stratification and decrease the energy required to maintain the room at a given temperature while conditioning the air to control temperature and humidity thereof.

2. Discussion of the Prior Art

Temperature stratification of air in a room caused by the rising of hot air and the descending of cold air causes heating and cooling equipment to be inefficient in maintaining a given temperature in the room in that the temperature differential between the floor and ceiling is normally from 10° to 24° F. An air circulating device for reducing such temperature stratification is disclosed in U.S. Pat. No. 3,973,479 to Isaac C. Whiteley, and this device represents a major step forward in the reduction of temperature stratification by replacing air drawn from one level of a room and supplied to another level with air drawn from the other level. In this manner, air circulation at both the ceiling and floor levels of a room is accomplished while air from the ceiling and floor levels is exchanged without requiring a natural return path, as required in the prior art as exemplified by U.S. Pat. Nos. 3,347,025 to Wiley and 3,827,342 to Hughes.

While the air circulating device of the Whiteley patent has been found to be extremely effective in reducing temperature stratification of rooms, the air circulating device of such patent does not modify or condition the air to serve as an air treatment or heating unit and, thus, has not as yet reached its full potential.

SUMMARY OF THE INVENTION

Accordingly, it is a primary object of the present invention to improve air circulation devices, such as that shown in the Whiteley 3,973,479 patent, by using such devices to condition air as well as to reduce temperature stratification.

An additional object of the present invention is to combine in a single air circulating device a pair of vertically extending ducts to reduce temperature stratification in a room, a humidifier for placing moisture in the air, such moisture being plain water or medicaments or deodorizers combined therewith, and a heater for heating the air such that the device is a self-contained unit for conditioning air in a room.

A further object of the present invention is to discharge cold air from the floor of a room at the ceiling at a rate of flow of two to four times the rate of flow at which hot air from the ceiling is discharged at the floor to eliminate floor drafts and obtain a proper mixture of hot and cold air.

The present invention has another object in that cold air from the floor of a room is discharged at the ceiling at an included angle of from 30° to 180° to the flow of hot air from the ceiling to be discharged at the floor.

Another object of the present invention is to mount fans and a humidifier in a conduit of an air circulating device with the conduit spring mounted within an outer housing to be disposed in a floating resilient condition to reduce noise.

The present invention has a further object in that a perforated sponge having holes therethrough aligned with the direction of air passing through the sponge is utilized to humidify air with a liquid, the liquid being held in a reservoir at a predetermined level under the automatic control of a container having a control tube with a bevelled end disposed at the predetermined level and a drip tube supplying liquid to the sponge and the reservoir.

An additional object of the present invention is to utilize an electrical heater with a humidifier in a floor-ceiling air circulating device, the heater being thermostatically controlled.

Yet another object of the present invention is to mount a germicidal lamp along a vertically extending duct of a floor-ceiling air circulating device to irradiate the air with ultraviolet light to kill germs therein.

Yet a further object of the present invention is to use a pair of fan blades on each driven shaft of an electric motor to move air in a floor-ceiling air circulating device such that the motor can be driven at low speed to move air with a minimum of noise and the fan blades can be adjusted axially and in pitch to control the volume of air moved by each pair of fan blades.

Some of the advantages of the present invention over the prior art are that efficient use of energy to maintain a room at a preset temperature is obtained by reducing temperature stratification of the room and the air circulating device can be utilized as a self-contained unit to condition air to control the humidity and temperature thereof.

The present invention is generally characterized in an air circulating device including a base adapted to be positioned on the floor of a room and having an inlet and an outlet therein, a duct extending from the base and communicating with the inlet to define a flow path into the base, a fan disposed in the base for drawing air through the first flow path and forcing the air through the base to the outlet, and a humidifier disposed in the base between the inlet and the outlet and including a reservoir of humidifying liquid, a liquid dispenser for automatically maintaining the level of humidifying liquid in the reservoir at a predetermined level, and a sponge having a portion thereof disposed in the reservoir below the predetermined level whereby air forced through the base is humidified by picking up moisture from the humidifying liquid as the air passes the sponge.

The present invention is further generally characterized in an air circulating device including a first duct having an inlet adapted to be disposed adjacent a ceiling of a room and an outlet adapted to be disposed adjacent a floor of the room to define a first flow path to deliver hot air from the ceiling to the floor, a second duct adjacent the first duct having an inlet adapted to be disposed adjacent the floor of the room and an outlet adapted to be disposed adjacent the ceiling of the room to define a second flow path to deliver cold air from the floor to the ceiling, a first fan disposed in the first flow path to deliver hot air from the ceiling to the floor at a first flow rate, and a second fan disposed in the second flow path to deliver cold air from the floor to the ceiling at a second flow rate greater than the first flow rate.

The present invention is further generally characterized in a method of circulating air in a room to reduce temperature stratification including the steps of drawing hot air from the ceiling of the room and discharging the hot air at the floor of the room at a first rate of flow, and drawing cold air from the floor of the room and discharging the cold air at the ceiling of the room at a second rate of flow greater than the first rate of flow.

Other objects and advantages of the present invention will become apparent from the following description of the preferred embodiment taken in conjunction with the accompanying drawings.

DESCRIPTION OF THE PREFERRED EMBODIMENT

Figure 1:
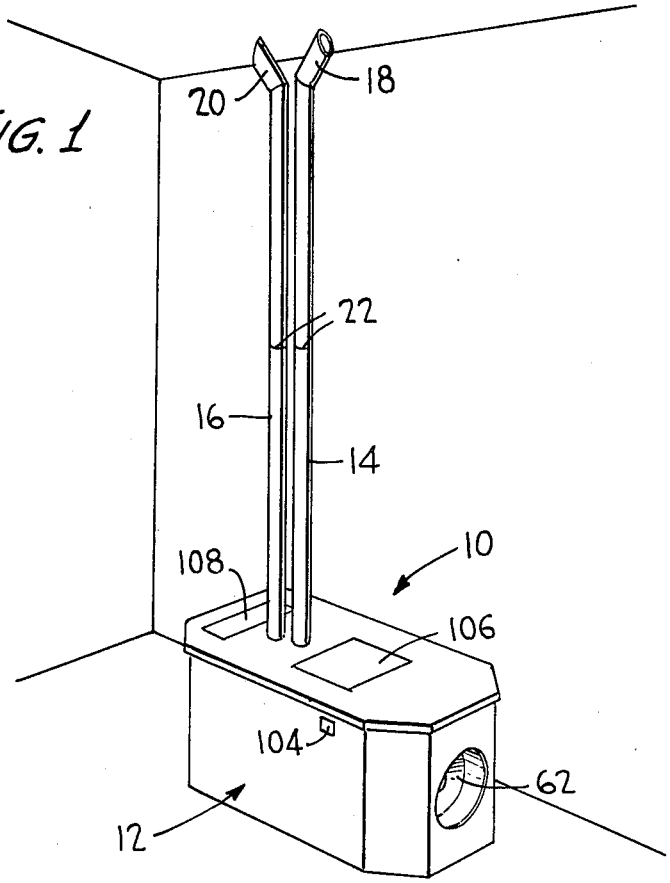
FIG. 1 is a perspective view of an air circulating device according to the present invention.

An air circulating device 10 according to the present invention is illustrated in FIG. 1 and includes a base, generally indicated at 12, adapted to be positioned on the floor of a room and a pair of ducts 14 and 16 extending in vertical parallel relation from the base 12 to angled extensions 18 and 20, respectively, adjacent the ceiling of the room. The ducts 14 and 16 are formed of upper and lower segments joined at rotatable joints 22 which permit the upper portions of the ducts to be turned to orient the angled extensions 18 and 20, as desired.

Figure 2:
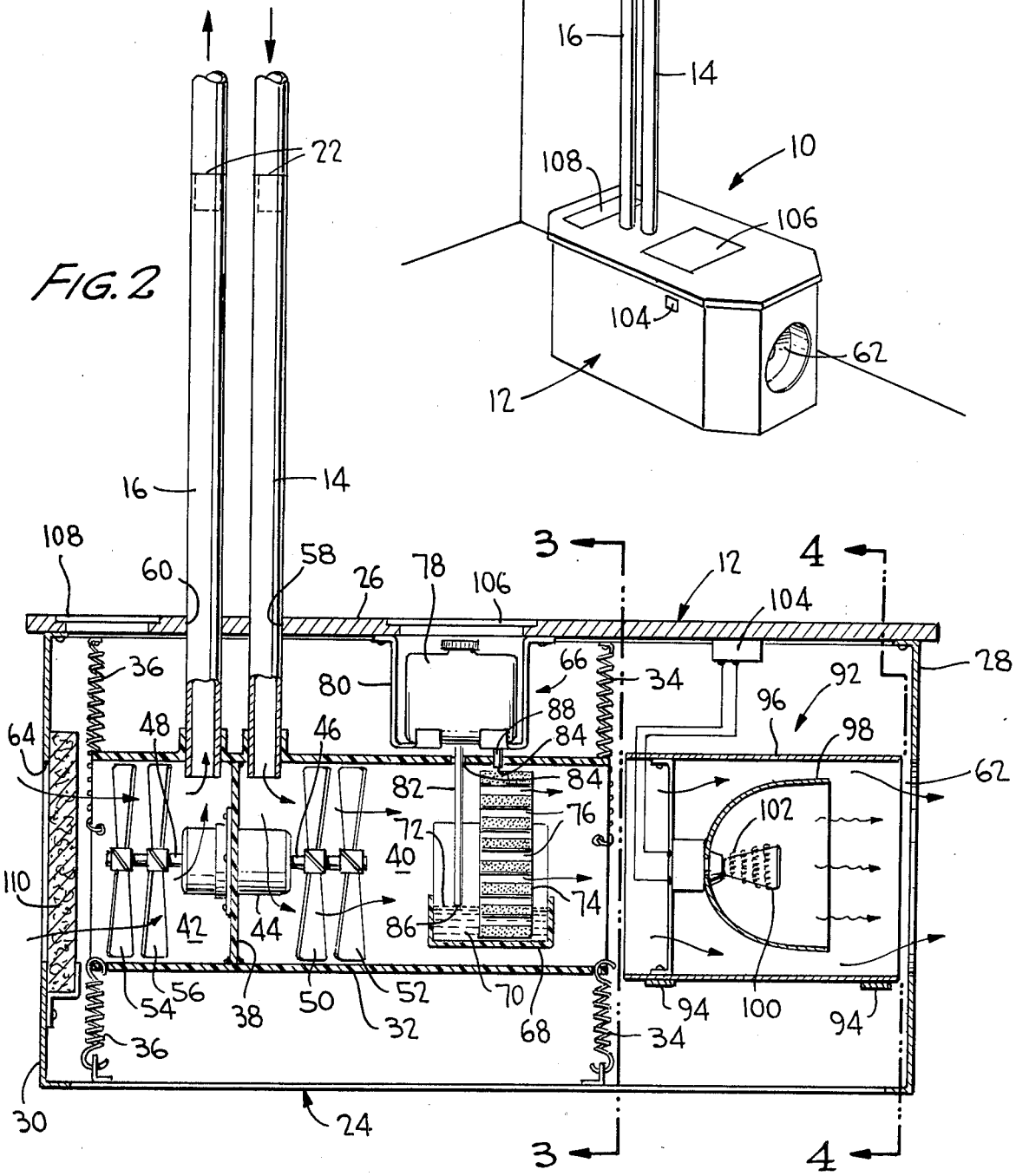
FIG. 2 is a vertical cross section of the air circulating device of FIG. 1.

As best shown in FIG. 2, the base 12 is formed of an outer housing 24 having an elongated shape with a bottom resting on the floor of the room, a top 26 and opposite end walls 28 and 30. The housing 24 is preferably constructed of wood or other suitable asthetically appealing material, and the housing is preferably of a size to be utilized as a seat or shelf in the manner of normal room furniture. A cylindrical plastic inner conduit 32 is resiliently mounted within the housing 24 by means of three, equally spaced coiled tension springs 34 at one end and three, equally spaced tension springs 36 at the other end. The conduit 32 has a partition 38 therein defining a chamber 40 and a chamber 42, and an electric motor 44 is mounted on the partition and has rotating shafts 46 and 48 extending therefrom. Shaft 46 mounts a pair of fan blades 50 and 52 within chamber 40 while shaft 48 mounts a pair of fan blades 54 and 56 in chamber 42, and the fan blades are oriented such that they rotate in the same direction to force air in the same direction (i.e. from left to right looking at FIG. 2). The duct 14 extends through an opening 58 in the top 26 of the housing to communicate with chamber 40 of the conduit 32 and form an inlet for the base 12 receiving air from the ceiling of the room. The duct 16 passes through an opening 60 in the top of housing 24 and communicates with chamber 42 of the conduit to provide an outlet for the base 12. The end wall 28 of the housing has an opening 62 therein forming another outlet for the base 12 and the end wall 30 has an opening 64 therein forming another inlet for the base 12.

Figure 3:
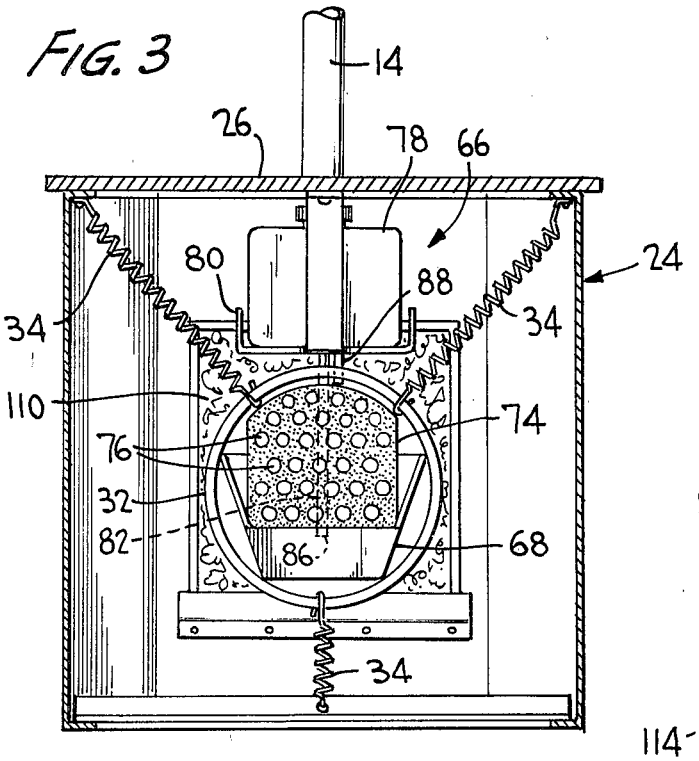
FIG. 3 is a section taken along line 3—3 of FIG. 2.

A humidifier, generally indicated at 66, is disposed within the base 12, as best shown in FIG. 3, and includes a reservoir 68 containing humidifying liquid 70 at a predetermined level 72. A perforated sponge 74 is positioned in the reservoir 68 with a portion thereof below the predetermined level 72, the sponge having holes 76 therein aligned with the direction of air flow through the chamber 40 of conduit 32. A control for automatically maintaining the humidifying liquid 70 at the predetermined level 72 includes a container 78 supported by a mount 80 fastened to the top 26 of the housing 24, and the container 78 has a control tube 82 extending from the bottom thereof through an opening 84 in the conduit 32, the control tube 82 terminating at a bevelled end 86 aligned with the predetermined level 72. A drip tube 88 also extends from the container 78 through an opening 90 and the conduit 32 above the sponge 74 to supply humidifying liquid stored in the container 78 to the sponge 74 and the reservoir 68.

Figure 4:
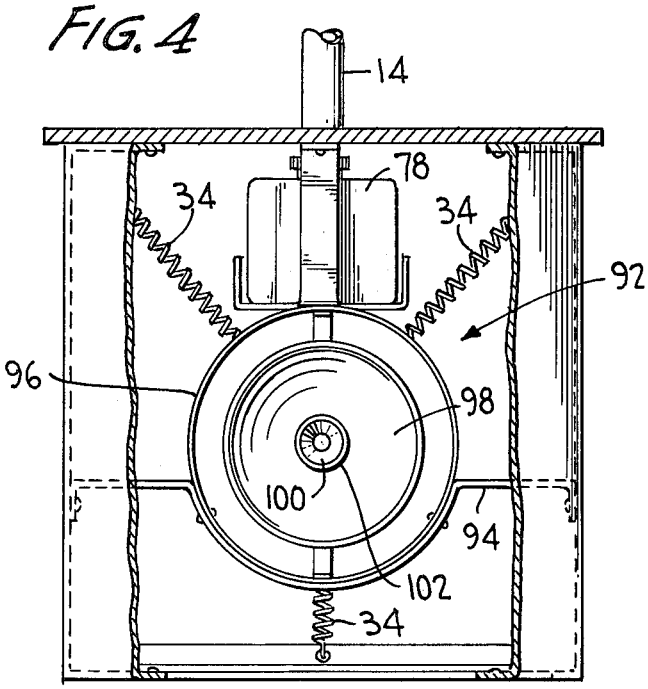
FIG. 4 is a section taken along line 4—4 of FIG. 2.

An electrical heater, generally indicated at 92, is mounted in the outer housing 24 adjacent end wall 28 by means of a pair of brackets 94 supporting a cylindrical shroud 96, as best shown in FIG. 4. Within the shroud 96 is a curved reflector 98 and a heating element 100 is wound on a conical element 102 within the reflector. Electricity is supplied to the heating element under the control of a thermostatic switch 104 mounted on a side wall of the housing so as to sense room temperature. The diameter of the shroud 96 is slightly greater than the diameter of the conduit 32 to compensate for movement of the cylinder due to its resilient, floating mounting, and the inner end of the shroud is disposed in close relation to the end of chamber 40 of conduit 32.

A door 106 is provided in the top 26 of the outer housing 24 to provide access to the container 78 and permit refilling thereof with humidifying liquid, and a door 108 is disposed in the top of the outer housing 24 adjacent end wall 30 to provide access to a fiberglass filter 110 mounted over the inlet defined by opening 64 to filter dust and other particles from the air.

In operation, the air circulating device 10 is positioned at any desired position within a room with the extensions 18 and 20 arranged with an included angle therebetween of 30° to 180°, and air from the floor of the room is drawn into chamber 42 via inlet 64 and filter 110 and is forced through duct 16 as an outlet to the ceiling at the angled extension 20 of the duct 16. The air exiting from the end 20 of the duct replaces air drawn through extension 18 of duct 14, which air is drawn into chamber 40 by fan blades 50 and 52 and forced through the holes 76 in perforated sponge 74 to pick up moisture from the humidifying liquid 70, the humidified air thereafter being heated by electrical heater 92 and forced out at outlet 62 to replace the air drawn from the floor at inlet 64.

The predetermined level 72 of humidifying liquid in the reservoir 68 is automatically controlled in that when the humidifying liquid in the reservoir covers the bevelled end 86 of the control tube 82, no air can enter the container 78 and, accordingly, liquid therein cannot exit via drip tube 84. However, once the level of humidifying liquid in the reservoir is reduced below the predetermined level due to moisture being picked up by the air from sponge 74, air will be permitted to flow through control tube 82 to replace liquid in container 78 and permit such liquid to be released from drip tube 84. The sponge 74 represents a simple and extremely efficient manner of humidifying the air in that the sponge receives liquid from the drip tube 84 and draws liquid from the reservoir 68 by capillary action.

Figure 5:
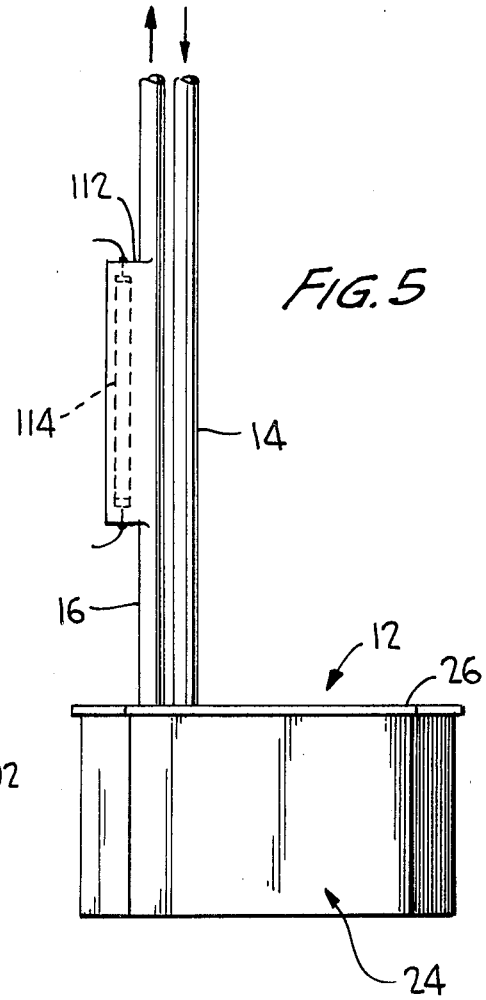
FIG. 5 is a side elevation of a modification of the air circulating device of FIG. 1.

In the modification illustrated in FIG. 5, the duct 16 has a large chamber 112 formed thereon, and a germicidal lamp 114 is mounted within the chamber 112 and arranged to irradiate air flowing through duct 16 with ultraviolet light to kill germs in the air.

The arranging of extension 18 and 20 such that the included angle between the flow of cold air from the floor out of the outlet formed by extension 20 and the flow of hot air from the ceiling into the inlet formed by extension 18 is between 30° and 180° assures that air discharged from extension 20 will not be directly drawn into extension 18, and the orientation of the extensions at an angle to the vertical, similarly, prevents direct drawing of discharged cold air into the inlet. Of course, the air circulating device 10 will operate to reduce temperature stratification regardless of the positioning and configuration of the extensions; however, temperature stratification reduction is maximized when the included angle between extensions 18 and 20 is between 30° and 180°.

It has also been found that floor drafts can be eliminated and the mixture of cold and hot air in the room can be optimized by causing fan blades 54 and 56 to draw cold air from the floor and discharge the cold air at the ceiling at a flow rate greater than the flow rate at which fan blades 50 and 52 draw hot air from the ceiling for discharge at the floor. Preferably, the rate of flow produced by fan blades 54 and 56 is from two to four times greater than the rate of flow produced by fan blades 50 and 52, and it has been determined that a cold air flow rate three times the hot air flow rate is particularly advantageous. For example, good results have been obtained with a cold air flow rate of 11.6 cfm and a hot air flow rate of 3.5 cfm. It should be noted that the terms "hot air" and "cold air" as used herein refer only to the relationship of air temperature caused by warmer air rising to the ceiling and cooler air descending to the floor.

The variance in flow rates can be accomplished by the use of different speed motors or gear mechanisms or the like; however, the use of a single electric motor 44 driving shafts 46 and 48 as described is preferred due to the quiet operation resulting from the use of a low speed motor with pairs of fan blades as compared to the use of a high speed motor with single fan blades. The rate of flow produced by the pairs of fan blades can be adjusted by controlling the pitch and axial spacing of the fan blades.

Any desirable liquid can be utilized to humidify the air via the humidifier 66, and the humidifier is particularly useful for deodorizing a room by adding a liquid deodorizing substance to the container 78. Similarly, medicaments, such as decongestants and inhalants, can be added to liquid within container 78 for use by persons having respiratory ailments.

Inasmuch as the present invention is subject to many variations, modifications and changes in detail, it is intended that all matter discussed above or shown in the accompanying drawings be interpreted as illustrative and not in a limiting sense.

What is claimed is:

1. An air circulating device comprising first duct means having an inlet adapted to be disposed adjacent a ceiling of a room and an outlet adapted to be disposed adjacent a floor of the room to define a first flow path to deliver hot air from the ceiling to the floor;

second duct means adjacent said first duct means having an inlet adapted to be disposed adjacent the floor of the room and an outlet adapted to be disposed adjacent the ceiling of the room to define a second flow path to deliver cold air from the floor to the ceiling;

first fan means disposed in said first flow path to deliver hot air from the ceiling to the floor at a first volumetric flow rate; and second fan means disposed in said second flow path to deliver cold air from the floor to the ceiling at a second volumetric flow rate at least two times greater than said first flow rate.

2. An air circulating device as recited in claim 1 wherein said second flow rate of delivering cold air from the floor to the ceiling is two to four times greater than said first flow rate of delivering hot air from the ceiling to the floor.

3. An air circulating device as recited in claim 1 and further comprising electric motor means driving first and second shafts, said first fan means including a first pair of fan blades mounted on said first shaft, and said second fan means including a second pair of fan blades mounted on said second shaft, said fan blades of said first and second pairs of fan blades varying in pitch and axial spacing such that said second pair of fan blades moves air at a greater flow rate than said first pair of fan blades.

4. An air circulating device as recited in claim 1 wherein said first duct means includes an extension defining said inlet and arranged to receive hot air from the ceiling at an angle to the vertical and said second duct means includes an extension defining said outlet and arranged to discharge cold air from the floor at the ceiling at an angle to the vertical.

5. An air circulating device as recited in claim 4 wherein said included angle between said extensions of said first and second duct means is between 30° and 180°.

6. An air circulating device as recited in claim 4 and further comprising electric heater means disposed in said first flow path.

7. An air circulating device as recited in claim 6 and further comprising base means mounting said first and second fan means and said heater means.

8. A method of circulating air in a room to reduce temperature stratification comprising the steps of drawing hot air from the ceiling of the room and discharging the hot air at the floor of the room at a first volumetric rate of flow; and drawing cold air from the floor of the room and discharging the cold air at the ceiling of the room at a second volumetric rate of flow at least two times greater than the first rate of flow.

9. The method as recited in claim 8 wherein said step of drawing hot air from the ceiling includes receiving hot air flow at an angle to the vertical, and said step of discharging cold air from the floor at the ceiling includes directing cold air flow at an angle to the vertical.

10. The method as recited in claim 9 wherein the included angle between the hot air flow received at the ceiling and the cold air flow discharged at the ceiling is between 30° and 180°.

11. The method as recited in claim 10 wherein the second rate of flow is two to four times greater than the first rate of flow.

12. The method as recited in claim 11 and further comprising the step of electrically heating the hot air discharged at the floor.

13. The method as recited in claim 12 and further comprising the step of humidifying the hot air discharged at the floor.

14. An air circulating device comprising base means adapted to be positioned on the floor of a room and having an inlet and an outlet therein;

duct means extending from said base means and communicating with said inlet to define a flow path into said base means;

fan means disposed in said base means for drawing air through said flow path and forcing the air through said base means to said outlet; and humidifier means disposed in said base means between said inlet and said outlet and including a reservoir of humidifying liquid, liquid dispenser means for automatically maintaining the level of humidifying liquid in said reservoir at a predetermined level, and sponge means having a portion thereof disposed in said reservoir below said predetermined level, said liquid dispenser means including a container for the humidifying liquid, a control tube extending from said container to a beveled bottom end disposed in said reservoir at said predetermined level and a drip tube extending from said container to supply the humidifying fluid to said sponge means and said reservoir only when the level of humidifying fluid in said reservoir is below said predetermined level to permit air to enter said beveled bottom end of said control tube, whereby air forced through said base means is humidified by picking up moisture from the hymidifying liquid as the air passes said sponge means.

15. An air circulating device as recited in claim 14 wherein said sponge means is perforated with holes extending therethrough in the direction of air flow from said inlet to said outlet.

16. An air circulating device as recited in claim 15 wherein said base means includes an outer housing and an inner conduit mounted in said outer housing for communicating with said inlet and said outlet, and said fan means, said reservoir and said sponge means are disposed in said conduit.

17. An air circulating device as recited in claim 16 wherein said base means includes spring means for resiliently mounting said conduit in said outer housing, said container being mounted in said outer housing and said conduit having an opening to permit passage of said control tube and said drip tube into said conduit.

18. An air circulating device as recited in claim 17 wherein said conduit is cylindrical and further comprising electrical heating means disposed in said outer housing and having a cylindrical shroud coaxially aligned with said conduit, said electrical heating means being positioned between said sponge means and said outlet of said base means, and said shroud having a diameter greater than the diameter of said conduit to compensate for the resilient mounting of said conduit in said outer housing by said spring means.

19. An air circulating device as recited in claim 18 wherein said outer housing has an opening therein defining a second inlet for said base means and said conduit has a partition defining a first chamber containing said fan means, said reservoir and said sponge means and a second chamber aligned with said second inlet and having an opening therein defining a second outlet for said base means, and further comprising second duct means communicating with said second outlet and extending through said outer housing, and fan means disposed in said second chamber for drawing air through said second inlet and forcing the air out through said second outlet and said second duct means.

20. An air circulating device as recited in claim 19 wherein said first mentioned duct means and said second duct means extend vertically in parallel relation to terminate adjacent a ceiling of the room whereby air drawn from the ceiling via said first mentioned duct means is replaced with air drawn from the floor via said second duct means and air drawn from the floor via said second duct means is replaced by air drawn from the ceiling via said first mentioned duct means.

21. An air circulating device as recited in claim 20 wherein said second duct means includes germicidal lamp means for irradiating air flowing through said second duct means with ultraviolet light.

22. An air circulating device as recited in claim 20 and further comprising electric motor means mounted in said partition in said conduit and having a first shaft driving said first mentioned fan means and a second shaft driving said second fan means, said first mentioned fan means and said second fan means each including a pair of fan blades secured to said first and second shafts, respectively.

* * * * *